US010712699B2

(12) United States Patent
Ogawa

(10) Patent No.: US 10,712,699 B2
(45) Date of Patent: Jul. 14, 2020

(54) IMAGE FORMING APPARATUS AND METHOD FOR MEASURING TONER CHARGE

(71) Applicant: Seiya Ogawa, Tokyo (JP)

(72) Inventor: Seiya Ogawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/596,995

(22) Filed: Oct. 9, 2019

(65) Prior Publication Data

US 2020/0117131 A1 Apr. 16, 2020

(30) Foreign Application Priority Data

Oct. 12, 2018 (JP) ..... 2018-193627

(51) Int. Cl.
*G03G 15/01* (2006.01)
*G03G 15/16* (2006.01)
*G03G 15/00* (2006.01)

(52) U.S. Cl.
CPC ..... *G03G 15/5041* (2013.01); *G03G 15/1605* (2013.01); *G03G 2215/00037* (2013.01)

(58) Field of Classification Search
CPC ..... G03G 15/5041; G03G 15/0131; G03G 15/1605; G03G 2215/00037; G03G 2215/0122
See application file for complete search history.

(56) References Cited

U.S. PATENT DOCUMENTS

| | | | | |
|---|---|---|---|---|
| 2015/0147079 | A1 | 5/2015 | Iwata et al. | |
| 2016/0266533 | A1* | 9/2016 | Takaya | G03G 15/556 |
| 2018/0017920 | A1* | 1/2018 | Aiba | G03G 15/5054 |
| 2019/0129328 | A1* | 5/2019 | Watanabe | G03G 15/5041 |
| 2019/0369522 | A1* | 12/2019 | Shimizu | G03G 15/5058 |

FOREIGN PATENT DOCUMENTS

| | | |
|---|---|---|
| JP | 3247959 | 1/2002 |
| JP | 2007-241117 | 9/2007 |
| JP | 2010-019969 | 1/2010 |

* cited by examiner

*Primary Examiner* — Sophia S Chen
(74) *Attorney, Agent, or Firm* — IPUSA, PLLC

(57) ABSTRACT

An image forming apparatus includes an intermediate transfer body, a plurality of image formation units arranged in a direction along which the intermediate transfer body moves. The plurality of image formation units includes a first image formation unit and at least one second image formation unit disposed downstream of the first image formation unit.

4 Claims, 10 Drawing Sheets

FIG.7

| | TRANSFER RATE | REVERSE-TRANSFER RATE | TRANSFER RATE WITH RESPECT TO REFERENCE TONER IMAGE |
|---|---|---|---|
| UPPERMOST STREAM (e.g., Y) | 92% | – | 84% |
| (e.g., M) | 92% | 3% | 87% |
| (e.g., C) | 92% | 3% | 89% |
| LOWERMOST STREAM (e.g., K) | 92% | 3% | 92% |

FIG.8

| | TRANSFER RATE | REVERSE-TRANSFER RATE | TRANSFER RATE WITH RESPECT TO REFERENCE TONER IMAGE |
|---|---|---|---|
| UPPERMOST STREAM (e.g., Y) | 92% | – | 89% |
| (e.g., M) | 90% | 1% | 88% |
| (e.g., C) | 90% | 1% | 89% |
| LOWERMOST STREAM (e.g., K) | 90% | 1% | 90% |

IMAGE FORMING APPARATUS AND METHOD FOR MEASURING TONER CHARGE

CROSS-REFERENCE TO RELATED APPLICATION

The present application claims priority under 35 U.S.C. § 119 to Japanese Patent Application No. 2018-193627, filed Oct. 12, 2018, the contents of which are incorporated herein by reference in their entirety.

BACKGROUND OF THE INVENTION

1. Field of the Invention

The present disclosure relates to an image forming apparatus and a method for measuring a toner charge.

2. Description of the Related Art

Electrophotographic image forming apparatuses are known to measure a toner charge per unit mass in order to avoid reductions in the quality of formed images or to avoid the scattering of toner within the apparatuses.

In developing an image in response to a developing bias voltage applied to a developing roller (toner bearer), techniques of measuring a toner charge per unit mass based on total toner charge and an adhered toner amount are disclosed. The total toner charge is measured based on a current value of a developing current that is supplied when toner is transferred from the developing roller to a photoconductor drum (image bearer), and the adhered toner amount is measured when the toner is initially transferred from the photoconductor drum onto an intermediate transfer belt (intermediate transfer body). See, for example, Japanese Patent No. 3247959, which may be hereafter referred to as Patent Document 1.

SUMMARY OF THE INVENTION

In one aspect according to the present disclosure, an image forming apparatus includes an intermediate transfer body, a plurality of image formation units arranged in a direction along which the intermediate transfer body moves, each image formation units including: a first image formation unit including a first toner bearer and a first image bearer, the first image formation unit being configured to move first toner on the first toner bearer to the first image bearer to form a first toner image on the first image bearer; and at least one second image formation unit disposed downstream of the first image formation unit. The second image formation unit includes a second toner bearer and a second image bearer, the second image formation unit being configured to move given second toner on the second toner bearer to the second image bearer to form a second toner image on the second image bearer. The image forming apparatus includes a first transfer unit configured to cause the first toner image to be transferred onto the first image bearer onto the intermediate transfer body based on a first transfer bias current supplied to the first transfer unit, the first toner image being a predetermined pattern of defined a reference toner image. The image forming apparatus includes at least one second transfer unit configured to cause the second toner image on the second image bearer to be transferred onto the intermediate transfer body based on a second transfer bias current supplied to the second transfer unit. The image forming apparatus includes a first measuring unit configured to measure a total charge of the first toner included in the reference toner image based on a developing current that flows in response to moving the first toner from the first toner bearer to the first image bearer. The image forming apparatus includes a second measuring unit configured to measure an adhered amount of the first toner included in the reference toner image that is transferred from the first image bearer onto the intermediate transfer body. The image forming apparatus includes a third measuring unit configured to measure a first toner charge per unit mass based on the total charge and the adhered amount. The image forming apparatus includes a current controller configured to set, with respect to the second transfer bias current, a first current value for measuring the first toner charge per unit mass and a second current value for forming an image on a print medium, the first current value being lower than a current value of the first transfer bias current, and the first current value being different from the second current value.

BRIEF DESCRIPTION OF THE DRAWINGS

FIG. 7 is a diagram for explaining an example of a transfer rate of a reference toner image with respect to each color;

FIG. 8 is a diagram for explaining an example of a transfer rate of a reference toner image with respect to each color in a case where a current value of a transfer bias current supplied to a primary transfer roller is set to be a lower limit;

DETAILED DESCRIPTION OF THE EMBODIMENTS

Figure 1:
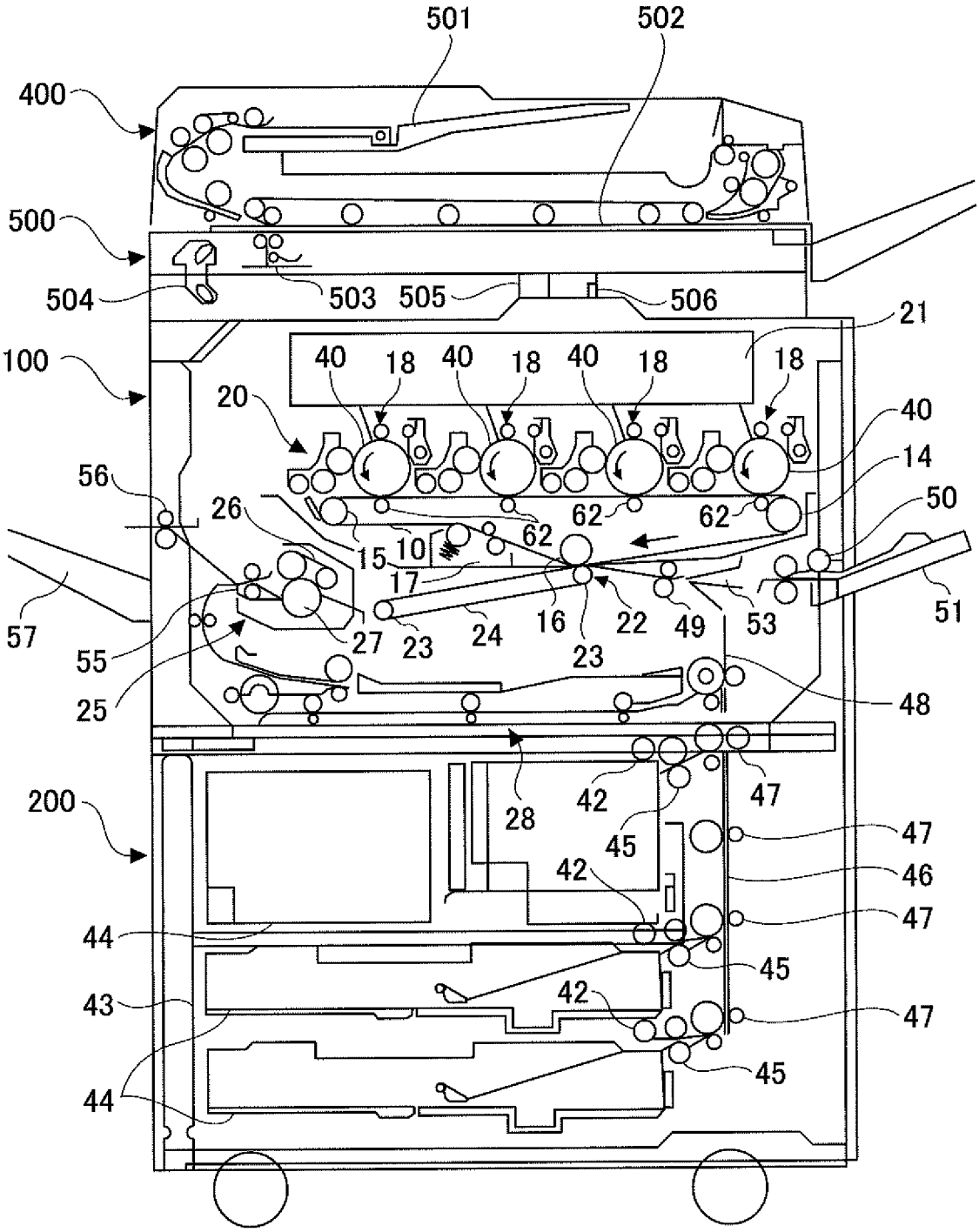
FIG. 1 is a diagram illustrating an example of a configuration of an image forming apparatus according to one or more embodiments.

Explanation will be hereinafter provided for one or more embodiments with reference to the drawings. In each figure, the same reference numerals are used to denote same elements; accordingly, for those elements, the explanation may be omitted.

A print medium in one or more embodiments includes a paper, a plastic sheet, or the like. In the following, by way of example, the print medium is taken as a paper. Note that the terms "forming an image" and "printing", etc. will be interchangeably used in one or more embodiments.

<Configuration of Image Forming Apparatus>

An image forming apparatus according to one or more embodiments will be described with reference to the drawings. In the following description, an electrophotographic image forming apparatus using an intermediate transfer belt, which is called a tandem system, will be described as an example.

FIG. 1 is a diagram illustrating an example of a configuration of an image forming apparatus according to one or more embodiments. As illustrated in FIG. 1, an image forming apparatus 100 includes an exposure unit 21, image formation devices 20 for respective colors, an intermediate transfer unit, a secondary transfer unit 22, and a fixing unit 25.

When a given image formation device 20 forms an image, the exposure unit 21 irradiates a photoconductor drum 40, which is provided with the given image formation device 20, with laser light to cause an electrostatic latent image to be formed on the photoconductor drum 40.

The image formation devices 20 for the respective colors are provided under the exposure unit 21. The respective image formation devices 20 for yellow (Y), magenta (M), cyan (C), and black (K) are disposed in this order in a direction along which the intermediate transfer belt 10 moves. Each image formation device 20 for a given color includes a photoconductor drum 40, develops an electrostatic latent image formed on the photoconductor drum 40, and forms a given color toner image on the photoconductor drum 40. Note that a configuration of the image formation device 20 will be described in detail below with reference to FIG. 2. In the following, yellow, magenta, cyan, and black may be represented by "Y," "M," "C," and "K," respectively.

The intermediate transfer unit is disposed under the image formation devices 20. The intermediate transfer unit includes the intermediate transfer belt 10 that is an endless belt, primary transfer rollers 62, and three supporting rollers 14, 15, and 16. The intermediate transfer belt 10 is rotated through supporting rollers 14, 15 and 16, and rotates in a clockwise direction. The primary transfer rollers 62 cause a toner image on a given photoconductor drum 40 for given color to be initially transferred onto the intermediate transfer belt 10.

The secondary transfer unit 22 is disposed under the intermediate transfer belt 10, and has two rollers 23 and a secondary transfer belt 24. The secondary transfer belt 24 is an endless belt, and is rotated by the two rollers 23. The rollers 23 and the secondary transfer belt 24 are mounted to push up the intermediate transfer belt 10 against the third supporting roller 16. The secondary transfer belt 24 causes a given toner image on the intermediate transfer belt 10 to be second transferred on a paper.

A cleaning unit 17 for an intermediate transfer body is disposed between the second supporting roller 15 and the third supporting roller 16. The cleaning unit 17 removes any residual toner remaining on the surface of the intermediate transfer belt 10, after the secondary transfer.

A fixing unit 25 is disposed on a left side of the secondary transfer unit 22, and includes a fixing belt 26 and a pressing roller 27. When a paper onto which a toner image is transferred is moved to the fixing unit 25, the fixing unit 25 fixes the toner image on the paper. The fixing belt 26 is an endless belt, and the pressing roller 27 is provided to press the fixing belt 26.

A sheet reversing unit 28 is provided under the secondary transfer unit 22 and the fixing unit 25. The paper reversing unit 28 reverses a front face of a moved paper into a back face of the paper. Note that the sheet reversing unit 28 is used to form an image on a back face of a paper after an image is formed on a front face of the paper.

An automatic document feeder (ADF) 400 conveys a paper onto a contact glass 502 when a start button, provided with an operation unit, is pressed and the paper is placed on a paper feeding table 501. On the other hand, when a paper is not placed on the paper feeding table 501, the automatic document feeder 400 activates an image scanner 500 to scan a paper that a user has placed on the contact glass 502.

The image scanner 500 includes a first carriage 503, a second carriage, an imaging lens 505, a CCD (Charge Coupled Device) 506, and a light source. The image scanner 500 drives the first carriage 503 and the second carriage 504 to scan a paper on the contact glass 502.

The light source provided with the first carriage 503 emits light toward the contact glass 502. Light from the light source is reflected from the paper on the contact glass 502. Next, the light is reflected toward the second carriage from a first mirror provided with the first carriage 503. The light reflected from the second carriage 504 is captured via an imaging lens 505 at a CCD (Charge Coupled Device) 506 that is a read sensor.

The image forming apparatus 100 generates image data of yellow, magenta, cyan, and black based on data obtained by the CCD 506.

The image forming apparatus 100 starts to rotate the intermediate transfer belt 10 in a case of the following: when a start button, provided with the operating unit, is pressed; when an instruction to form an image is received from an external device, such as a personal computer; or when an instruction to transmit a facsimile is received.

When the intermediate transfer belt 10 starts to rotate, the image formation device 20 starts a process of forming an image. A paper onto which a toner image is transferred is moved to the fixing unit 25. The toner image is fixed on the paper by the fixing unit 25, so that an image is thereby formed on the paper.

A paper feeding table 200 includes paper feeding rollers 42, a paper feeding unit 43, separating rollers 45, and a conveying roller unit 48. The paper feeding unit 43 includes a plurality of paper feeding trays 44, and the conveying roller unit 48 includes conveying rollers 47.

The paper feeding table 200 selects one paper feeding roller from among the plurality of paper feeding rollers 42. The paper feeding table 200 rotates the selected feeding roller 42.

The paper feeding unit 43 selects one paper feeding tray from among a plurality of paper feeding trays 44, and picks up papers in the selected paper feeding tray 44. One sheet of paper is extracted from the picked papers by a separating roller 45, and then is conveyed along a conveying path 46, by the conveying rollers 47.

The conveyed paper is conveyed to resist rollers 49 along the paper feeding path 53. The paper is then sandwiched by the resist rollers 49 to stop. Further, the paper is conveyed to the secondary transfer unit 22 at a timing at which a toner image enters the secondary transfer unit 22.

Note that the paper may be fed from a bypass tray 51. When a paper is fed from the bypass tray 51, the image forming apparatus 100 rotates the paper feeding roller 50. The paper feeding roller 50 extracts one sheet of paper from a plurality of sheets of paper on the bypass tray 51, and conveys an extracted paper to a paper feeding pass 53. The paper conveyed to the paper feeding pass 53 is further conveyed to resist rollers 49. A process performed after the paper is conveyed to the resist rollers 49 is same as a process performed when a paper is conveyed from the paper feeding table 200.

The paper is fixed by a fixing process through the fixing unit 25, and then is ejected from the fixing unit 25. The ejected paper is moved to ejection rollers 56 by a switching claw 55. The ejection rollers move the paper to an ejection tray 57, and then the paper is ejected from the image forming apparatus 100.

The switching claw 55 may convey a paper ejected from the fixing unit 25 to the sheet reversing unit 28. The sheet reversing unit 28 reverses the printable surface of the conveyed paper from a front face of the paper to a back face of the paper. On the back face of the reversed paper, an image is formed in a same manner as the front face of the paper, and the paper is conveyed to the paper ejection tray 57. In such a manner, the image forming apparatus 100 forms an image on the paper.

<Configuration of Image Formation Device>

Figure 2:
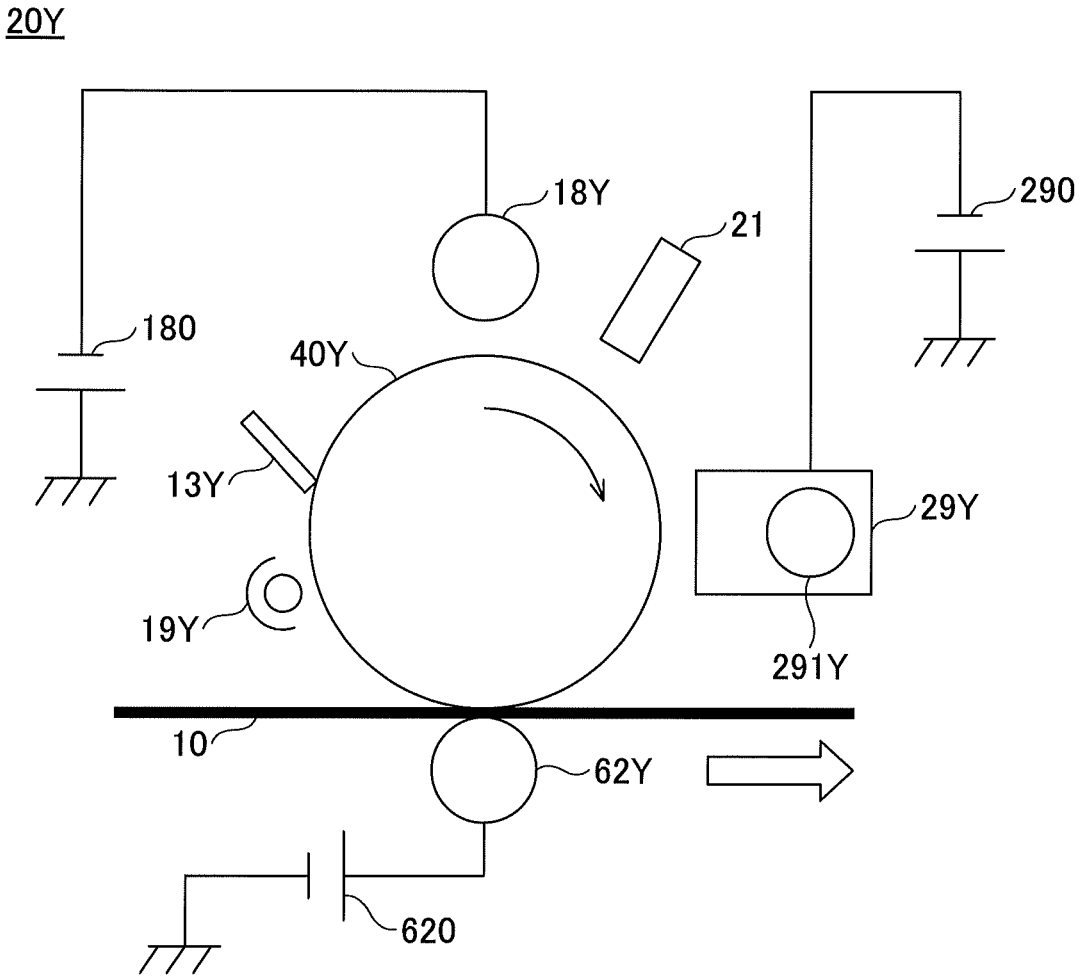
FIG. 2 is a diagram illustrating an example of a configuration of an image formation device according to one or more embodiments.

Hereafter, a configuration of the image formation device 20 according to one or more embodiments will be described with reference to FIG. 2. FIG. 2 is a diagram illustrating an example of a configuration of an image formation device 20. In FIG. 2, as an example, a configuration of an image formation device 20Y for yellow is illustrated. Each of three image formation devices 20M, 20C, and 20K for three colors has the same configuration as the image formation device 20Y for yellow, except that toner colors differ from each other. Accordingly, separate explanations and figures for each of the image formation devices 20M, 20C, and 20K, will not be provided. Hereafter, the image formation device 20Y for yellow will be described.

The image formation device 20Y includes a developing device 29Y, a charging roller 18Y, a photoconductor drum 40Y, a cleaning blade 13Y, and a neutralizer 19Y. A primary transfer roller 62Y is disposed to face the image formation device 20Y across an intermediate transfer belt 10.

The developing device 29Y includes a developing roller 291Y that faces the photoconductor drum 40Y. The developing roller 291Y includes one or more magnets and a sleeve that rotates around the magnets. The magnets are disposed in the developing device 29Y, and have magnetic poles on a circumferential surface of a roller. The developing roller 291Y can hold toner on a roller surface through a plurality of magnetic poles that are created on the roller surface.

The charging roller 18Y is a roller member in which an elastic layer having medium resistance is coated in an outer periphery of a conductive cored bar. A charging bias voltage supplied by a high voltage power supply 180 for charging is applied to the charging roller 18Y, and a surface of the photoconductor drum 40Y facing the charging roller 18Y is uniformly charged.

The photoconductor drum 40Y is a negatively charged organic photoreceptor that includes a photosensitive layer or the like on a drum-shaped conductive support. The photoconductor drum 40Y is charged by the charging roller 18Y, and is then exposed according to an image signal, by the exposure unit 21. In such a manner, an electrostatic latent image is formed on a surface of the photoconductor drum 40Y.

When a developing bias voltage supplied by a high voltage power supply 290 for developing is applied to the developing roller 291Y, toner on the developing roller 291Y moves onto the photoconductor drum 40Y. Thereby, an electrostatic latent image is visualized, and thus a toner image is formed on the photoconductor drum 40Y.

In contrast, when a transfer bias current supplied by the high voltage power supply 620 for transfer is supplied to a primary transfer roller 62Y, the toner image on the photoconductor drum 40Y is initially transferred onto the intermediate transfer belt 10.

The residual toner and the like remaining on the photoconductor drum 40Y without primary transfer are mechanically removed by the cleaning blade 13Y that contacts the surface of the photoconductor drum 40Y. Electrical charge stored on a surface of the photoconductor drum 40Y is neutralized by the neutralizer 19Y.

The image formation devices 20M, 20C, and 20K that have the same configuration as the image formation device 20Y are sequentially disposed in a direction along which the intermediate transfer belt 10 moves, as indicated by a blank arrow in FIG. 2. Respective toner images formed by the image formation devices 20Y, 20M, 20C, and 20K are initially transferred to and superimposed on the intermediate transfer belt 10, so that a multicolored toner image is formed on the intermediate transfer belt 10. As described above, the multicolored toner image on the intermediate transfer belt 10 is next transferred onto a paper by the secondary transfer unit 22, and is fixed on the paper by the fixing unit 25.

<Measurement of Toner Charge Per Unit Mass>

With respect to an electrophotographic image forming apparatus, the toner charge per unit mass may decrease due to changes in temperature and humidity in surroundings of the apparatus, deterioration of developer, or the like. As a result, the quality of the formed image may be decreased, or the toner may become scattered within the apparatus. In view of the point described above, in one or more embodiments, the toner charge per unit mass is measured for allowing adjustment of conditions of forming an image or replacement of developer material, etc.

In measuring the toner charge per unit mass, a total charge Q of toner included in a reference toner image, as well as an adhered amount M1 of toner included in the reference toner image that is transferred onto the intermediate transfer belt 10, are measured. By dividing the total charge Q of toner by the adhered amount M1 of toner, the toner charge per unit mass Q/M1 (which may be simply referred to as a toner charge Q/M1 hereafter) can be obtained.

When a reference toner image is formed on a photoconductor drum, a developing current that is supplied in moving toner from a developing roller onto the photoconductor drum in accordance with a developing bias voltage, is temporally integrated, and thus the total charge Q of toner can be determined.

Note that the reference toner image refers to a toner image having a predetermined pattern. The total charge Q of toner and the adhered amount M1 of toner vary depending on a pattern of a toner image. For this reason, a reference toner image having a predetermined pattern is used for measuring the toner charge Q/M1. A pattern of the reference toner image may be of rectangle or the like. In this case, toner used in the pattern of the reference toner image may have a uniform concentration.

The adhered amount M1 of toner refers to an amount of toner included in a transfer-reference toner image, which is a reference toner image on a given photoconductor drum being initially transferred onto the intermediate transfer belt. As described below, the adhered amount M1 of toner can be obtained by a toner concentration sensor that measures the toner concentration extracted from a transfer-reference toner image.

Figure 3:
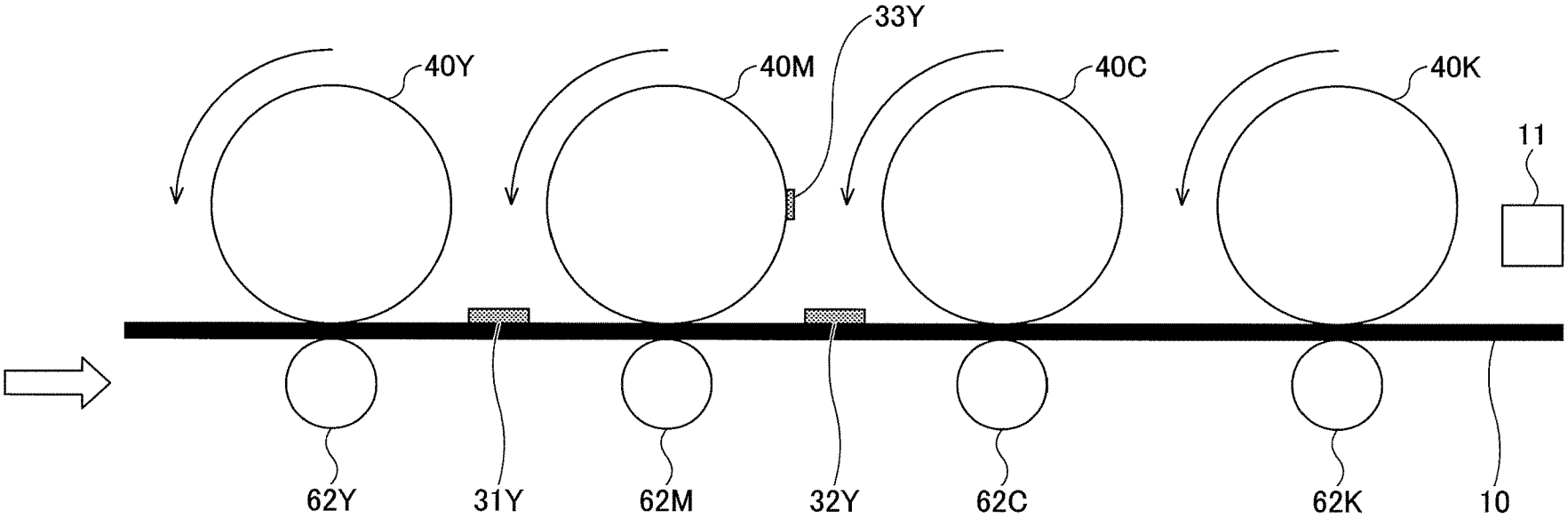
FIG. 3 is a diagram for explaining an example of measuring a toner charge with respect to each color.

The toner charge Q/M1 can be measured for each toner color. FIG. 3 is a diagram for explaining an example of measuring the toner charge Q/M1 with respect to each color. In FIG. 3, photoconductor drums 40Y, 40M, 40C, and 40K are provided above an intermediate transfer belt 10. The photoconductor drums 40Y, 40M, 40C, and 40K are arranged in a direction (direction represented by a blank arrow) in which the intermediate transfer belt 10 moves. Note that a configuration of each image formation device other than a photoconductor drum, is not illustrated in FIG. 3.

A primary transfer roller 62Y is provided under the intermediate transfer belt 10 to face a photoconductor drum 40Y. Similarly, a primary transfer roller 62M is provided to face a photoconductor drum 40M, a primary transfer roller 62C is provided to face a photoconductor drum 40C, and a primary transfer roller 62K is provided to face a photoconductor drum 40K. A toner concentration sensor 11 is also provided further downstream of the photoconductor drum 40K, which is provided last in the sequence of color photo drums.

For example, in a case of measuring the yellow toner charge Q/M1, a reference yellow toner image is formed on the photoconductor drum 40Y, and is initially transferred onto the intermediate transfer belt 10. In such a manner, a transfer-reference yellow toner image is formed. In this case, other colored toner images are not formed, and only a transfer-reference yellow toner image is formed on the intermediate transfer belt 10. A toner concentration extracted from the transfer-reference yellow toner image is measured by a toner concentration sensor 11. An adhered amount M1 of toner is obtained based on a measured value of the toner concentration. By dividing the total yellow toner charge Q by the adhered amount M1 of toner, the yellow toner charge Q/M1 can be measured.

Similarly, in a case of measuring the magenta toner charge Q/M1, a reference magenta toner image is formed on a photoconductor drum 40M, and is initially transferred onto the intermediate transfer belt 10. In such a manner, only a transfer-reference magenta toner image is formed. By dividing a total magenta toner charge Q by the adhered amount M1 of toner in the transfer-reference toner image, the magenta toner charge Q/M1 can be measured. The cyan toner charge Q/M1 and the black toner charge Q/M1 can be also measured in a same manner as the magenta toner charge Q/M1.

In a case of measuring a given colored toner charge Q/M1, toner included in a transfer-reference toner image that is formed on the intermediate transfer belt may adhere to other photoconductor drum(s) other than a photoconductor drum for a given color. Such adhesion is referred to as a reverse transfer.

In measuring a given colored toner charge Q/M1, other photoconductor drums for colors other than given color are not used for forming respective colored toner images. However, because the other photoconductor drums contact the intermediate transfer belt 10, when a given colored toner image passes through points at which the other photoconductor drums are disposed, a portion of toner included in a given transfer-reference toner image on the intermediate transfer belt 10 may be peeled off through contact to be reversely transferred onto other photoconductor drum(s).

In FIG. 3, in a case of measuring a yellow toner charge Q/M1, toner in a transfer-reference toner image 31Y of yellow is partially peeled off to be reversely transferred onto the photoconductor drum 40M for magenta. The numeral 33Y indicates the reversely transferred toner.

The adhered amount M1 of toner included in a transfer-reference toner image 32Y in FIG. 3 is decreased by an amount of the reversely transferred toner 33Y, compared to the adhered amount M1 of toner included in the transfer-reference toner image 31Y. This decrease may result in the determination of an erroneous yellow toner charge Q/M1.

In a case of yellow toner, toner included in a given transfer-reference toner image may be reversely transferred onto each of three photoconductor drums downstream in a direction along which the intermediate transfer belt 10 moves. In a case of magenta toner, toner included in a given transfer-reference toner image may be reversely transferred onto each of two photoconductor drums downstream in a direction along which the intermediate transfer belt 10 moves. In a case of cyan toner, toner included in a given transfer-reference toner image may be reversely transferred onto one photoconductor drum downstream in a direction along which the intermediate transfer belt 10 moves.

In other words, the number of the downstream photoconductor drums increases the further upstream in the direction of movement of the intermediate transfer belt 10 that a given toner image is formed. Accordingly, with respect to a colored toner image formed upstream, an amount of reversely transferred toner is increased, and thus the toner charge Q/M1 may be subject to greater measurement error. For this reason, when a failure, such as when yellow toner and the like of colored toner images formed upstream is scattered in the image forming apparatus 100, occurs, the failure might not be properly addressed due to the measurement error of a given toner charge Q/M1.

One or more embodiments reduce the error in a given measurement of the toner charge Q/M1 caused by the reverse transfer of toner described above. Hereafter, a configuration and a function of the image forming apparatus 100 according to one or more embodiments will be described in detail.

<Hardware Configuration of Image Forming Apparatus>

Figure 4:
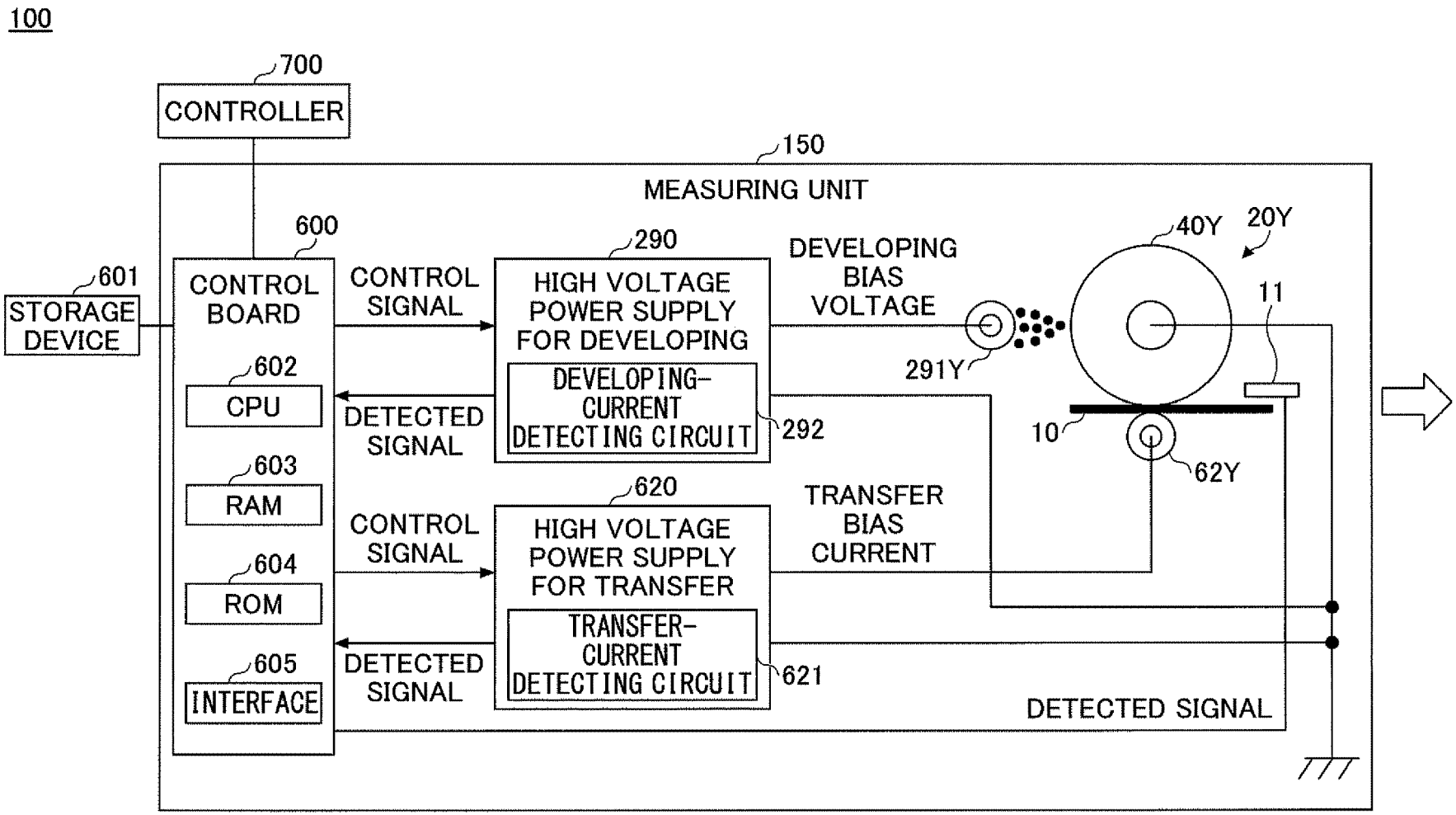
FIG. 4 is a block diagram illustrating an example of a hardware configuration of the image forming apparatus according to one or more embodiments.

With reference to FIG. 4, a hardware configuration of the image forming apparatus 100 according to one or more embodiments will be described. FIG. 4 is a block diagram illustrating an example of the hardware configuration of the image forming apparatus 100. The image forming apparatus 100 includes a measuring unit 150 for measuring toner charges Q/M1, and includes a controller 700 that controls the entire image forming apparatus 100.

The measuring unit 150 includes a high voltage power supply 290 for developing, a high voltage power supply 620 for transfer, a toner concentration sensor 11, a control board 600, a storage device 601, and a controller 700.

The high voltage power supply 290 for developing is electrically coupled to a developing roller 291Y that is provided with an image formation device 20Y. The high voltage power supply 290 for developing applies a supplied DC (direct current) developing bias voltage to the developing roller 291Y. An output value of the high voltage power supply 290 for developing is controlled in accordance with a control signal that is transmitted from the control board 600.

The high voltage power supply 290 for developing also includes a developing-current detecting circuit 292. The developing-current detecting circuit 292 detects the output current of the high voltage power supply 290 for developing. The developing-current detecting circuit 292 can also transmit a detected signal indicative of a current value to the control board 600. Note that, instead of an output current of the high voltage power supply 290 for developing, the developing-current detecting circuit 292 may detect a current that flows to the developing-current detecting circuit 292 from the developing roller 291Y through the photoconductor drum 40Y.

The high voltage power supply 620 for transfer is electrically coupled to a primary transfer roller 62Y, and supplies a supplied DC transfer bias current to the primary transfer roller 62Y. An output value of the high voltage power supply 620 for transfer is controlled in accordance with a control signal that is transmitted from the control board 600.

The high voltage power supply 620 for transfer also includes a transfer-current detecting circuit 621. The transfer-current detecting circuit 621 can detect the output current of the high voltage power supply 620 for transfer, and transmit a detected signal indicative of a current value to the control board 600.

The toner concentration sensor 11 is disposed downstream of the image formation device 20Y in a direction along which the intermediate transfer belt 10 moves. The toner concentration sensor 11 includes an LED (Light Emitting Diode) for emitting light and a PD (Photo Diode) for receiving light. The LED irradiates a toner image on the intermediate transfer belt 10 with light. The PD measures the intensity of light reflected from a toner image, and outputs a signal indicative of the detected value to the control board 600.

The control board 600 includes a CPU (Central Processing Unit) 602, a RAM (Random Access Memory) 603, a ROM (Read Only Memory) 604, and an interface 605. The control board 600 measures a toner charge Q/M1. The CPU 602, the RAM 603, the ROM 604, and the interface 605 are electrically interconnected via a system bus that is not illustrated.

The CPU 602 is an arithmetic device that allows for control and functions of the entire control board 600. The arithmetic device reads program(s) or data in a storage device such as the ROM 604, into the RAM 603 to execute a process.

The RAM 603 is a volatile semiconductor memory that temporarily stores program(s) and data. The ROM 604 is a non-volatile semiconductor memory that is capable of storing program(s) and data even when the image forming apparatus is turned off. The ROM 604 stores programs and data for setting BIOS (Basic Input and Output System) and OS (Operating System), which is executed when the control board 600 is booted.

The storage device 601 stores various data such as: data indicating the correlation between the detected signal of light intensity measured by the toner concentration sensor 11 and the toner concentration; and data indicating the total toner charge Q obtained based on a developing current. The storage device 601 is a storage device such as an HDD (hard disk drive).

The controller 700 controls the entire image forming apparatus 100. The controller 700 can have functions such as an interface with an external device, an instruction for starting or ending of forming an image, and time management of various items.

Note that, in FIG. 4, the image formation device 20Y for yellow and the primary transfer roller 62Y are illustrated only, and other image formation devices 20M, 20C, and 20K for respective colors and primary transfer rollers 62M, 62C, and 62K are not illustrated. However, the image forming apparatus 100 includes the other image formation devices for respective colors and the primary transfer rollers. The image formation devices 20Y, 20M, 20C, and 20K are sequentially arranged in a direction (direction indicated by a blank arrow) along which the intermediate transfer belt 10 moves. The primary transfer roller 62Y is provided to face the image formation device 20Y, and the primary transfer roller 62M is provided to face the image formation device 20M. The primary transfer roller 62C is provided to face the image formation device 20C, and the primary transfer roller 62K is provided to face the image formation device 20K.

The high voltage power supply 290 for developing is electrically coupled to the developing rollers 291Y, 291M, 291C, and 291K. The high voltage power supply 290 for developing can apply a developing bias voltage to each of the developing rollers 291Y, 291M, 2910, and 291K. The high voltage power supply 620 for transfer is electrically coupled to the primary transfer rollers 62Y, 62M, 62C, and 62K. The high voltage power supply 620 for transfer can supply a transfer bias current to each of the primary transfer rollers 62Y, 62M, 62C, and 62K.

The toner concentration sensor 11 is disposed further downstream of the image formation device 20K among the plurality of image formation device, the image formation device 20K being disposed in a lowermost stream of a direction along which the intermediate transfer belt 10 moves. The toner concentration sensor 11 can measure a toner concentration extracted from each of respective transfer-reference toner images for yellow, magenta, cyan, and black (see FIG. 3).

First Embodiment

<Functional Configuration of Image Forming Apparatus>

Figure 5:
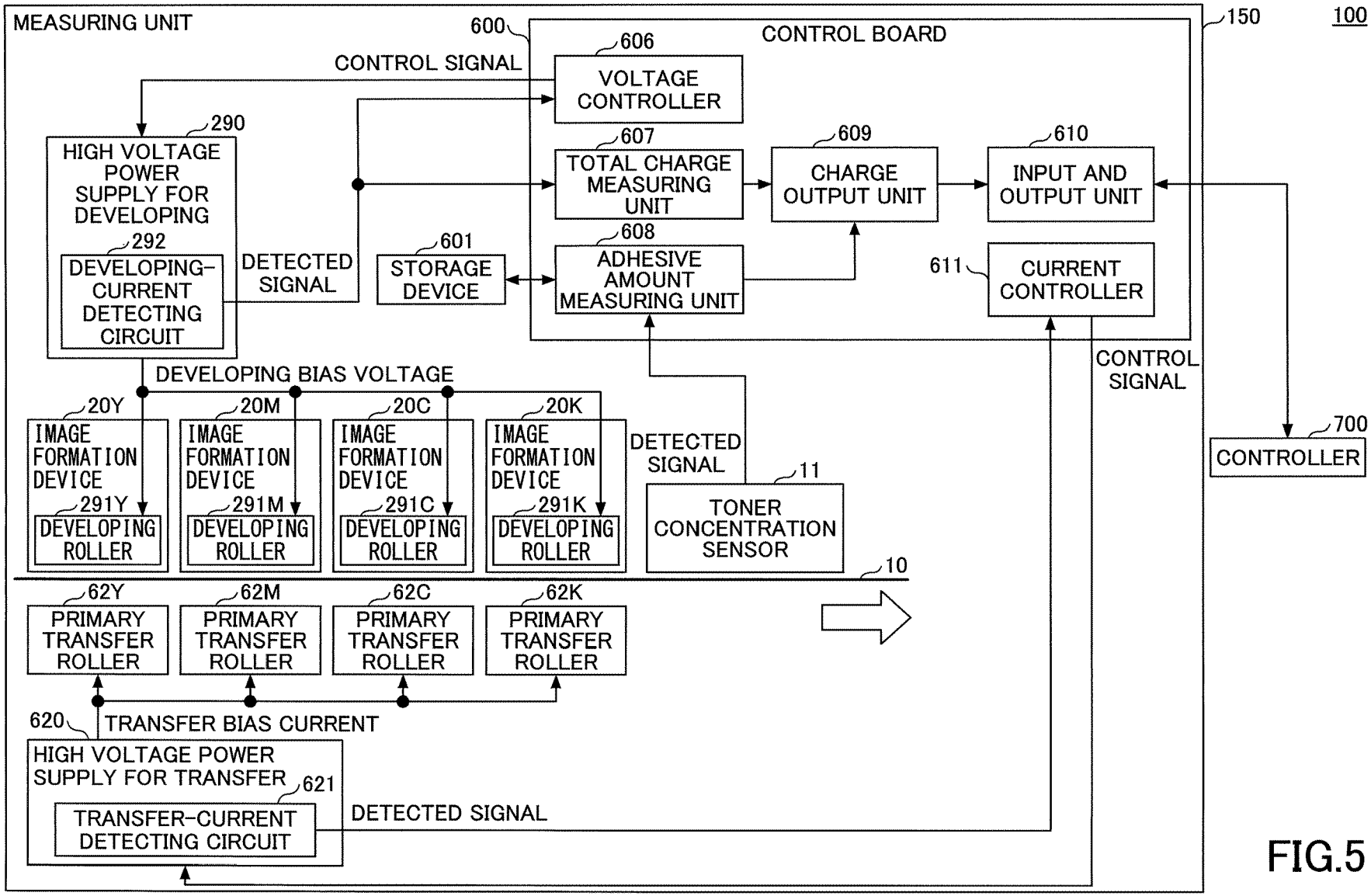
FIG. 5 is a functional block diagram illustrating an example of components of the image forming apparatus according to a first embodiment.

Hereafter, a functional configuration of the image forming apparatus 100 according to a first embodiment will be described with reference to FIG. 5. FIG. 5 is a functional block diagram illustrating an example of the components of the image forming apparatus 100. Note that in FIG. 5, functional blocks of the image forming apparatus 100 are conceptual, and may not be physically configured as illustrated in FIG. 5. All or some functional blocks may be functionally or physically dispersed in any unit, or be functionally or physically combined in any unit.

The control board 600 provided with the measuring unit 150 includes a voltage controller 606, a total charge measuring unit 607, an adhered amount measuring unit 608, a charge output unit 609, an input and output unit 610, and a current controller 611.

The voltage controller 606 is electrically coupled to the high voltage power supply 290 for developing. The voltage controller 606 performs a process of constant voltage control with respect to a developing bias voltage, which the high voltage power supply 290 for developing applies to each of the developing rollers 291Y, 291M, 291C, and 291K. In the process of constant voltage control, the voltage controller 606 generates a PWM (Pulse Width Modulation) signal based on a detected signal from the developing-current detecting circuit 292 to output, as a control signal, the PWM signal to the high voltage power supply 290 for developing.

The total charge measuring unit 607 is electrically coupled to the developing-current detecting circuit 292. The total charge measuring unit 607 receives a signal indicating the detected current value of a developing current detected by the developing-current detecting circuit 292. The total charge measuring unit 607 temporally integrates received developing current values to obtain a total toner charge Q. The total charge measuring unit 607 outputs the total toner charge Q to the charge output unit 609.

The adhered amount measuring unit 608 is electrically coupled to the toner concentration sensor 11. The adhered amount measuring unit 608 receives a detected signal from the toner concentration sensor 11.

Data indicating a correlation between the toner concentration and the intensity of reflected light of a transfer-reference toner image, which is measured by the toner concentration sensor 11, is preliminarily obtained and is stored in the storage device 601. In such a manner, with reference to storage device 601, the adhered amount measuring unit 608 can obtain the toner concentration based on the detected signal indicating received light intensity.

The above toner concentration means the adhered toner amount per unit area M1/A (g/m$^2$) with respect to an area where light is emitted within a transfer-reference toner image. The adhered amount measuring unit 608 multiplies the adhered toner amount M1/A by the pattern area of a transfer-reference toner image to obtain the adhered amount M1 of toner included in the entire pattern of a transfer-reference toner image. The adhered amount measuring unit 608 outputs a signal indicating the obtained adhered amount M1 of toner to the charge output unit 609.

The charge output unit 609 divides the received total toner charge Q by the adhered amount M1 of toner to obtain the toner charge Q/M1. Further, the charge output unit 609 outputs the toner charge Q/M1 to the control unit 700, the storage device 601, or/and the like, via the input and output unit 610.

The input and output unit 610 is implemented by the interface 605 or the like, and allows for input and output of data or signals, between the controller 700 and the storage device 601.

The current controller 611 is electrically coupled to the high voltage power supply 620 for transfer. The current controller 611 performs a process of constant current control with respect to a transfer bias current that is supplied to each of the primary transfer rollers 62Y, 62M, 62C, and 62K by the high voltage power supply 620 for transfer.

In the process of constant current control, the current controller 611 generates a PWM (Pulse Width Modulation) signal based on a detected signal from the transfer-current detecting circuit 621, and outputs, as a control signal, the PWM signal to the high voltage power supply 620 for transfer.

Hereafter, a current value of the transfer bias current controlled by the current controller 611 will be described.

As described above, in measuring a toner charge Q/M1 with respect to a given colored toner image (e.g., yellow) that is formed upstream in a direction along which the intermediate transfer belt 10 moves, a portion of toner included in a given transfer-reference toner image may be reversely transferred onto downstream photoconductor drum(s), and thus there may be a measurement error.

Because toner is negatively charged on a given photoconductor drum, when a positive transfer bias current is supplied to a given primary transfer roller, the negatively charged toner on the given photoconductor drum is attracted to the given primary transfer roller. Thereby, the toner can be initially transferred onto the intermediate transfer belt 10.

Toner that is initially transferred onto the intermediate transfer belt 10 through an upstream primary transfer roller (e.g., primary transfer roller 62Y) is positively charged by primary transfer. Meanwhile, in measuring a toner charge Q/M1 with respect to an upstream formed toner image, although downstream image formation device(s) (e.g., image formation device 20M) do not form an image, a positive transfer bias current is supplied to the downstream primary transfer roller(s) (e.g., primary transfer roller 62M).

In such a manner, the toner included in a transfer-reference toner image is repelled by a positive transfer bias current supplied to the downstream primary transfer roller 62M. As a result, the toner is peeled off from the intermediate transfer belt 10, and thus may adhere to the photoconductor drum 40M. Such an approach leads to reverse transfer from an intermediate transfer belt to photoconductor drum(s). For example, repulsive force increases as a current value of a transfer bias current flowing to a downstream primary transfer roller increases, and thus reverse transfer is more likely to occur.

In the present embodiment, in measuring a toner charge Q/M1, the current controller 611 sets a current value I2 of a transfer bias current supplied to each of the primary transfer rollers 62M, 62C, and 62K, which are disposed downstream of the primary transfer roller 62Y, to be lower than a current value I1 of a transfer bias current supplied to the primary transfer roller 62Y.

Thereby, when toner passes through respective points where the photoconductor drums 40M, 40C, and 40K are disposed downstream of the photoconductor drums 40Y, the repulsive force of the positively charged toner included in a transfer-reference yellow toner image can be suppressed. Accordingly, a portion of toner included in a transfer-reference toner image can be prevented from being reversely transferred onto the photoconductor drums 40M, 40C, and 40K.

Note that, in the above description, a transfer bias current having a same current value I2 is supplied to each of the primary transfer rollers 62M, 62C, and 62K. However, the value of the transfer bias current supplied to each of the primary transfer rollers 62M, 62C, and 62K may have a different value I2, as long as the value I2 is lower than a current value I1.

However, when the current value I2 of a transfer bias current is below the current value I1, as described above, in a case where an image is formed on a paper, the force of downstream primary transfer rollers 62M, 62C and 62K in attracting toner on the respective photoconductor drums 40M, 40C, and 40K is decreased. For this reason, there may be unevenness through primary transfer, thereby a failure of forming images such as a void may occur.

In view of the issue described above, the current controller 611 sets a current value I2 of the transfer bias current to be lower than a current value I1, as described above. Further, the current controller 611 sets the current value I2 to be different from a current value I3 of a transfer bias current supplied to each of the primary transfer rollers 62M, 62C, and 62K, when the image forming apparatus 100 forms an image on a paper. For example, the current controller 611 sets a current value I2 of a transfer bias current in a case of measuring a toner charge Q/M1 to be lower than a current value I3 of a transfer bias current in a case where the image forming apparatus 100 forms an image on a paper.

Thereby, in a case of forming an image on a paper, it is possible to ensure sufficient attractive force of downstream photoconductor drums 40M, 40C, and 40K attracting toner on the respective primary transfer rollers 62M, 62C, and 62K. Accordingly, it is possible to suppress unevenness through primary transfer to prevent a fault of forming an image such as a void.

Note that in the above description, a transfer bias current having the same current value I2 is supplied to each of the primary transfer rollers 62M, 62C, and 62K, and a transfer bias current having the same current value I3 is supplied to each of the primary transfer rollers 62M, 62C, and 62K. However, the transfer bias current is not limited to the examples described above.

Specifically, in a case of measuring the toner charge Q/M1, a transfer bias current supplied to the primary transfer roller 62M is set as a current value I2M, a transfer bias current supplied to the primary transfer roller 62C is set as a current value I2C, and a transfer bias current supplied to the primary transfer roller 62K is set as a current value I2K. Also, in the case of forming an image on the paper, a transfer bias current supplied to the primary transfer roller 62M is set as a current value I3M, a transfer bias current supplied to the primary transfer roller 62C is set as a current value I3C, and a transfer bias current supplied to the primary transfer roller 62K is set as a current value I3K. In this case, when the current values I2M, I2C, and I2K differ respectively, from the current values I3M, I3C, and I3K, the current values I3M, I3C, and I3K may be different from each other.

The image formation device 20Y is an example of a "first image formation unit," the developing roller 291Y is an example of a "toner bearer," and the photoconductor drum 40Y is an example of a "first image bearer." The primary transfer roller 62Y is an example of a "first transfer unit," and the current value I1 of the transfer bias current supplied to the primary transfer roller 62Y is an example of a "first transfer bias current."

Each of the image formation devices 20M, 20C, and 20K is an example of a "second image formation unit," and each of the photoconductor drums 40M, 40C, and 40K is an example of a "second image bearer." Each of the primary transfer rollers 62M, 62C, and 62K is an example of a "second transfer bearer," and the current value I2 of the transfer bias current supplied to the primary transfer rollers 62M, 62C and 62K is an example of a "second transfer bias current." The intermediate transfer belt 10 is an example of an "intermediate transfer body."

As an example, in the present embodiment, the measurement of the yellow toner charge Q/M1 is described, but is not limited to the example described above. In a case of measuring the magenta toner charge Q/M1, a current value I2 of a transfer bias current supplied to the primary transfer rollers 62C and 62K, which are disposed downstream of the primary transfer roller 62M, may be lower than a current value I1 of a transfer bias current supplied to the primary transfer roller 62M.

In a case of measuring the magenta toner charge Q/M1, the image formation device 20M is an example of a "first image formation unit," the developing roller 291M is an example of a "toner bearer," and the photoconductor drum 40M is an example of a "first image bearer." The primary transfer roller 62M is an example of a "first transfer unit," and the current value I1 of the transfer bias current supplied to the primary transfer roller 62M is an example of a "first transfer bias current."

Each of the image formation devices 20C and 20K is an examples of a "second image formation unit," and each of the photoconductor drums 40C and 40K is an example of a "second image bearer." Each of the primary transfer rollers 62C and 62K is an example of a "second transfer unit," and a current value I2 of a transfer bias current supplied to each of the primary transfer rollers 62C and 62K is an example of a "second transfer bias current."

Similarly, in a case of measuring the cyan toner charge Q/M1, a current value I2 of a transfer bias current supplied to the primary transfer roller 62K, which is disposed downstream of the primary transfer roller 62C, may be lower than a current value I1 of a transfer bias current supplied to the primary transfer roller 62C.

In the case of measuring the cyan toner charge Q/M1, the image formation device 20C is an example of a "first image formation unit," the developing roller 291C is an example of a "toner bearer," and the photoconductor drum 40C is an example of a "first image bearer." The primary transfer roller 62C is an example of a "first transfer unit," and the current value I1 of the transfer bias current supplied to the primary transfer roller 62C is an example of a "first transfer bias current."

The image formation device 20K is an example of a "second image formation unit," and the photoconductor drum 40K is an example of a "second image bearer." The primary transfer roller 62K is an example of a "second transfer unit," and the current value I2 of a transfer bias current supplied to the primary transfer roller 62K is an example of a "second transfer bias current."

Figure 6:
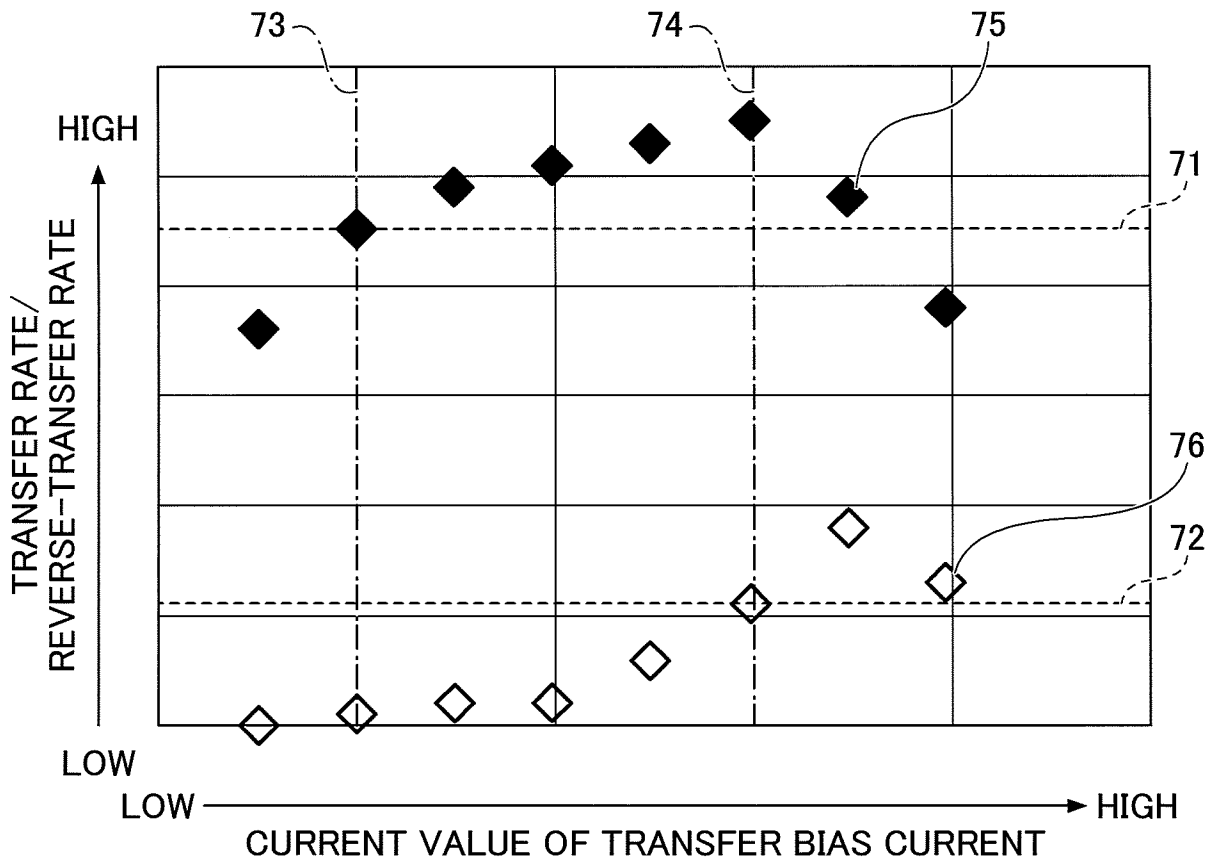
FIG. 6 is a diagram for explaining an example of a relationship between a current value of a transfer bias current and either of a transfer rate or a reverse-transfer rate.

FIG. 6 is a diagram for explaining an example of the relationship between the current value of a transfer bias current and either of the transfer rate or a reverse-transfer rate, with respect to a transfer bias current supplied to a given primary transfer roller disposed downstream of the primary transfer roller 62Y.

The transfer rate refers to a value $(m2/m1)\times100(\%)$. Where, m1 indicates the amount of toner that is moved from a given photoconductor drum to the intermediate transfer belt 10 to adhere to the intermediate transfer belt 10 in forming a reference toner image, and m2 indicates the amount of toner that is initially transferred from a given photoconductor drum onto the intermediate transfer belt 10 to adhere to the intermediate transfer belt 10. A reverse-transfer rate refers to a value $(m3/m2)\times100(\%)$. Where, m3 indicates an amount of toner that is reversely transferred onto a downstream photoconductor drum. Note that the relationship between the transfer rate or the transfer bias current is determined by the resistance value of the transfer belt, material of the photoconductor drum surface, or the like. Such a relationship is independent of the relationship between the reverse-transfer rate and the transfer bias current.

In FIG. 6, the horizontal axis represents the current value of a transfer bias current supplied to a given primary transfer roller (e.g., a primary transfer roller 62M) that is disposed downstream of the primary transfer roller 62Y. The vertical axis represents a transfer rate and a reverse-transfer rate. In FIG. 6, a black diamond plot 75 indicates the transfer rate, and the blank diamond plot 76 indicates a reverse-transfer rate.

The dashed line 71 indicates the permissible lower limit of a transfer rate, and the dashed line 72 indicates the permissible upper limit of a reverse-transfer rate. For example, when an image is formed on a paper, in a case where the transfer rate is higher than the permissible lower limit of the transfer rate, it is possible to suppress an image formation fault, such as a void. In a case where the transfer rate is lower than the permissible upper limit of the reverse-transfer rate, it is possible to suppress reverse transfer, thereby decreasing the error in the measured toner charge Q/M1.

The single dashed-dotted line 73 indicates the lower limit of a transfer bias current that allows a higher transfer rate than the permissible lower limit of the transfer rate. The single dashed-dotted line 74 indicates the upper limit of the transfer bias current that allows a lower reverse-transfer rate than the permissible upper limit of the reverse-transfer rate.

In such a manner, a current value of the transfer bias current may be set within a permissible range of values defined by the single dashed-dotted line 73 and the single dashed-dotted line 74.

For example, when the current value of the transfer bias current supplied to the primary transfer roller for each color is set to allow a transfer rate of 92% and the reverse-transfer rate of 3%, which are within the permissible range described above, in a case of measuring toner charges Q/M1, the transfer rates of reference toner images of respective colors are illustrated in FIG. 7. In FIG. 7, the transfer rate of the reference yellow toner image, which is formed first, is 84%, which is lower than the transfer rate with respect to each other color. In this case, in measuring the yellow toner charge Q/M1, a measurement error is increased.

FIG. 8 is a diagram for explaining an example of a transfer rate of the reference toner image with respect to each color in a case where the transfer bias current supplied to the primary transfer roller of each subsequent downstream colored image is set to be the lower limit of the transfer bias current. In this example, the transfer rate of the reference toner image for each color is indicated in a case where the current value I2 of the transfer bias current supplied to primary transfer rollers of each subsequent downstream colored image is lower than a current value I1 of a transfer bias current supplied to a given upstream primary transfer roller of each subsequent downstream colored image.

In FIG. 8, the transfer rate of a yellow reference toner image, which is formed first, is 89%, and thus is similar to a transfer rate with respect to each other color. When such a current value I2 is set, it is possible to suppress a measurement error of a yellow toner charge Q/M1.

When an image is formed on a paper, in a case where the current value of the transfer bias current supplied to each subsequent primary transfer roller for each downstream color is reset to allow a transfer rate of 92% and a reverse-transfer rate of 3%, as illustrated in FIG. 7, the force of attracting toner on a given photoconductor drum is secured. Thereby, it is possible to suppress a failure of forming an image, such as a void.

In such a manner, errors in the measured toner charge Q/M1 can be suppressed as well as suppressing a fault of forming an image on a paper, such as a void.

<Operation of Image Forming Apparatus>

Figure 9:
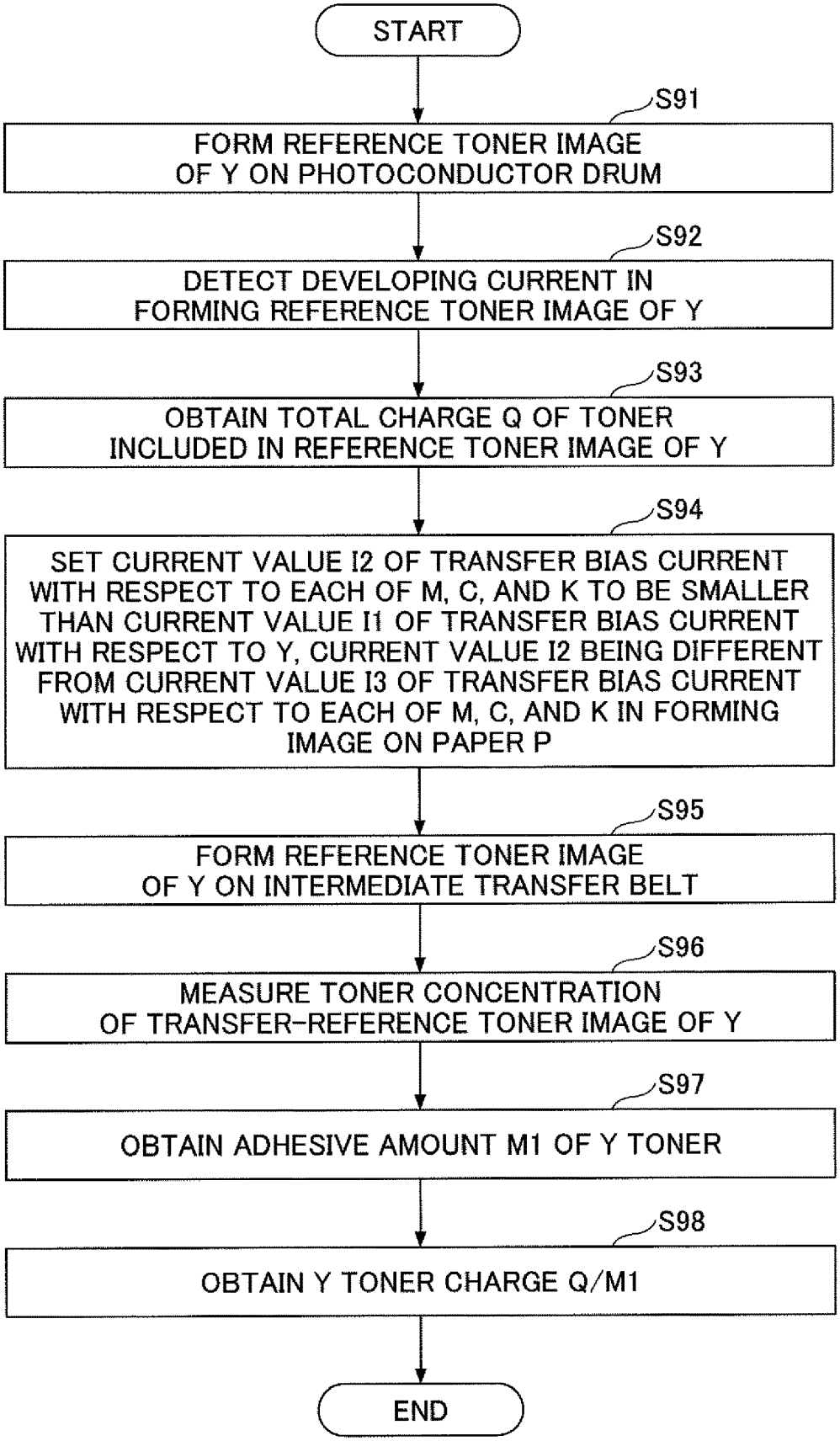
FIG. 9 is a flowchart illustrating an example of a process of measuring a toner charge in the image forming apparatus according to the first embodiment.

FIG. 9 is a flowchart illustrating an example of a process of measuring a toner charge in the image forming apparatus 100 according to the present embodiment. In FIG. 9, a process of measuring a yellow toner charge Q/M1 is illustrated.

First, in step S91, the image formation device 20Y applies a developing bias voltage from a high voltage power supply 290 for developing to a developing roller 291Y, and forms a reference yellow toner image on a photoconductor drum 40Y.

Subsequently, in step S92, the developing-current detecting circuit 292 detects the developing current in a case where the image formation device 20Y forms the reference yellow toner image on the photoconductor drum 40Y. The developing-current detecting circuit 292 also outputs a signal indicating the detected value to a total charge measuring unit 607.

In such a manner, when the reference yellow toner image is formed on the photoconductor drum 40Y, the image formation device 20Y forms the reference yellow toner image, while rotating the photoconductor drum 40Y in a predetermined rotational direction. In this case, the developing-current detecting circuit 292 detects a developing current in a predetermined period of time from a first time point, at which an upper end portion of a reference toner image is formed in the rotational direction, to a second time point at which a lower end portion of the reference toner image is formed. The developing-current detecting circuit 292 then outputs detected signals indicating respective current values to the total charge measuring unit 607. The total charge measuring unit 607 temporarily stores received current values of the developing current in the RAM 603 or the like.

In step S93, the total charge measuring unit 607 retrieves the temporarily stored current values of the developing current from the RAM 603 or the like. The total charge measuring unit 607 temporally integrates the current values of the developing current in a period from the first time point to the second time point. As a result, the total charge measuring unit 607 obtains a total charge Q of the reference yellow toner image. The total charge measuring unit 607 outputs a signal indicating the obtained total charge Q to a charge output unit 609.

In step S94, the current controller 611 sets the current value I2 of the transfer bias current, which is supplied to each of the primary transfer rollers 62M, 62C, and 62K, to be lower than the current value I1 of the transfer bias current supplied to the primary transfer roller 62Y. Further, the current controller 611 sets the current value I2 to be different from the current value I3 of the transfer bias current supplied to each of the primary transfer rollers 62M, 62C and 62K, in a case of forming an image on a paper.

In step S95, the high voltage power supply 620 for transfer supplies the transfer bias current having the current value I1 to the primary transfer roller 62Y. The primary transfer roller 62Y causes a transfer-reference yellow toner image to be formed on the intermediate transfer belt 10.

In step S96, the toner concentration sensor 11 measures the toner concentration of the transfer-reference toner image on the intermediate transfer belt 10, and outputs a signal indicating the detected value to the adhered amount measuring unit 608.

In step S97, the adhered amount measuring unit 608 multiplies the adhered toner amount per unit mass M1/A by the pattern area of the reference-transfer toner image. Where, the adhered toner amount per unit mass M1/A corresponds to the detected value of the toner concentration. The adhered amount measuring unit 608 thus obtains the adhered amount M1 of the toner in the entire pattern of the transfer-reference toner image. The adhered amount measuring unit 608 outputs a signal indicating the obtained adhered amount M1 of the toner to the charge output unit 609.

Subsequently, in step S98, the charge output unit 609 divides the received total charge Q of the toner by the adhered amount M1 of the toner to obtain the toner charge Q/M1. The charge output unit 609 outputs the toner charge Q/M1 to the controller 700 or/and the storage device 601, etc. via the input and output unit 610.

In such a manner, the image forming apparatus 100 can measure a yellow toner charge Q/M1.

Note that, in a case of measuring the magenta toner charge Q/M1, a toner color used in each step may be taken as magenta. In this case, in step S94, the current value I2 of the transfer bias current supplied to the primary transfer rollers 62C and 62K, which are disposed downstream of the primary transfer roller 62M, may be set to be lower than the current value I1 of the transfer bias current supplied to the primary transfer roller 62M. Further, the current value I2 may be set to differ from the current value I3 of the transfer bias current supplied to the primary transfer rollers 62C and 62K, in a case of forming an image on a paper.

In a case of measuring the cyan toner charge Q/M1, a toner color used in each step may be taken as cyan. In this case, in step S94, the current value I2 of the transfer bias current supplied to the primary transfer roller 62K, which are disposed downstream of the primary transfer roller 62C, may be set to be lower than the current value I1 of the transfer bias current supplied to the primary transfer roller 62C. Further, the current value I2 may be set to differ from the current value I3 of a transfer bias current supplied to the primary transfer roller 62K, in a case of forming an image on a paper.

In a case of measuring the black toner charge Q/M1, a toner color used in each step may be taken as black. In this case, because there are no downstream primary transfer rollers, the process in step S94 may be skipped.

As described above, in the present embodiment, when a given toner charge Q/M1 is measured, the current value I2 of the transfer bias current supplied to downstream primary transfer roller(s) (e.g., primary transfer rollers 62M, 62C, and 62K), which are disposed downstream of a given primary transfer roller (e.g., primary transfer roller 62Y) for target color, is set to be lower than the current value I1 of the transfer bias current supplied to the given primary transfer roller. Further, the current value I2 is set to be different from the current value I3 of the transfer bias current supplied to downstream primary transfer roller(s), the current value I3 being set when an image is formed on a paper.

Accordingly, when toner passes through each point where a photoconductor drum is disposed downstream of a given target color photoconductor drum, the repulsive force of positively charged toner included in the transfer-reference yellow toner image is suppressed. Thereby, a portion of toner included the transfer-reference yellow toner image can be prevented from being peeled off from the intermediate transfer belt to suppress toner being reversely transferred onto photoconductor drum(s). Further, a given toner charge per unit mass Q/M1 can be properly measured. When an image is formed on a paper RPM the force of attracting toner on a given color photoconductor drum is ensured in a case of being transferred first. Thereby, unevenness through primary transfer is suppressed, and thus a failure of forming images, such a void, can be suppressed.

Second Embodiment

Hereafter, an example of an image forming apparatus according to a second embodiment will be described. Note that explanation will be omitted for elements that are identical or sufficiently similar to elements that have been described in the first embodiment.

Figure 10:
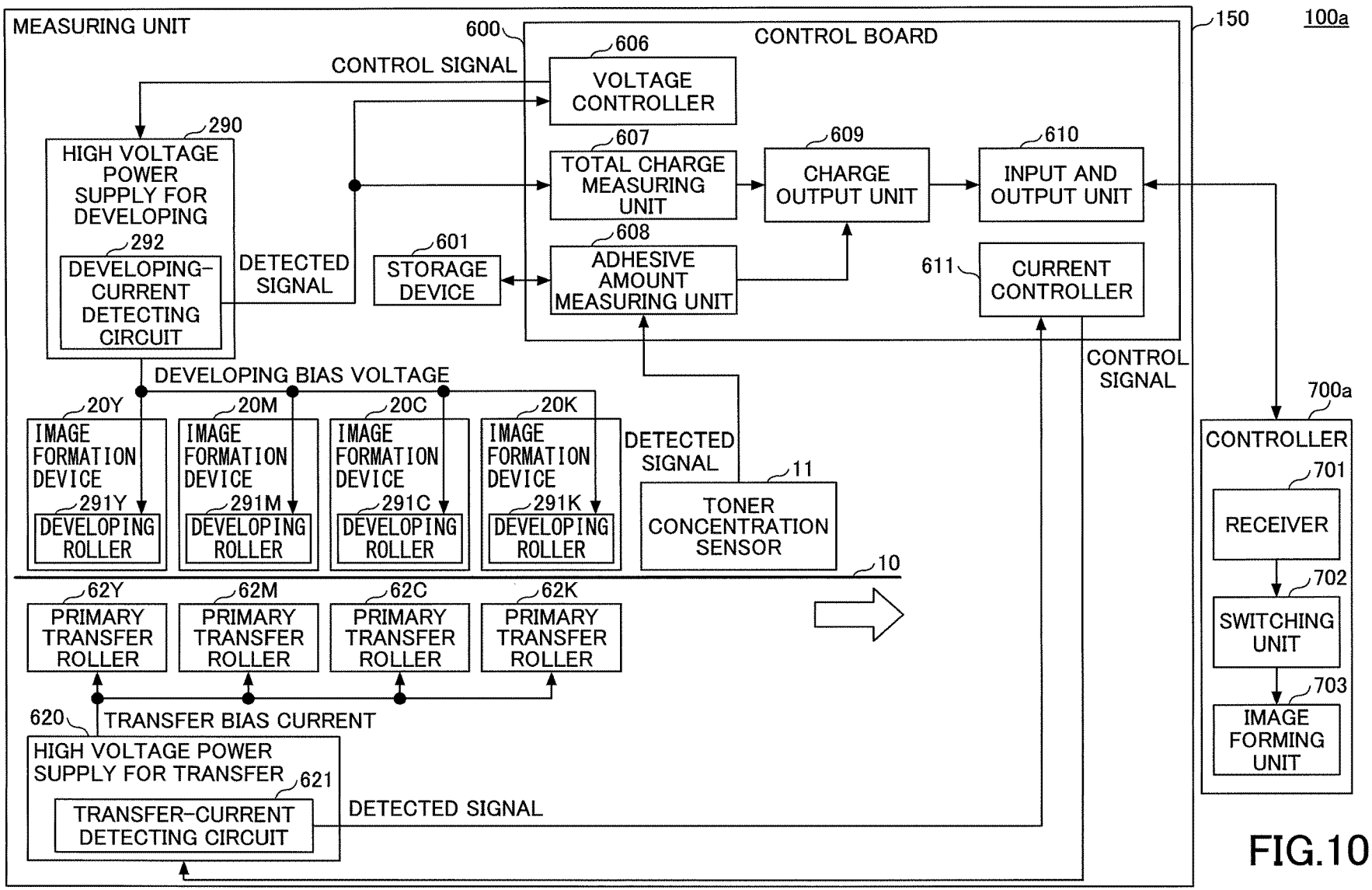
FIG. 10 is a functional block diagram illustrating an example of components of an image forming apparatus according to a second embodiment.

FIG. 10 is a functional block diagram illustrating an example of components of an image forming apparatus 100*a* according to the present embodiment.

The image forming apparatus 100*a* includes a controller 700*a*. The controller 700*a* comprehensively controls the operation of the image forming apparatus 100*a*. The controller 700*a* includes a CPU, a ROM and a RAM. The CPU uses the RAM as a work area, and executes a program stored in the ROM to achieve a function and control of the controller 700*a*.

The controller 700*a* includes a receiver 701, a switching unit 702 and an image forming unit 703. The receiver 701 receives a switching signal for switching operation modes of the image forming apparatus 100*a*, the switching signal being received from an operation unit or the like provided with the image forming apparatus 100*a*. The receiver 701 outputs a received switching signal to the switching unit 702.

In response to a received switching signal, the switching unit 702 switches the operation modes of the image forming apparatus 100*a* between a first operation mode of forming an image on paper and a second operation mode of measuring the toner charge Q/M1. The second operation mode is different from the first operation mode. When the image forming apparatus 100*a* operates in the first operation mode, the switching unit 702 outputs, to the image forming unit 703, an image-forming start signal for instructing a start to form an image. When the image forming apparatus 100*a* operates in the second operation mode, the switching unit 702 outputs, to the control board 600, a measuring-start signal for instructing a start to measure a toner charge Q/M1.

The control board 600 starts to measure the toner charge Q/M1 described in the first embodiment in accordance with a measuring-start signal that is received via the input and output unit 610. In contrast, the image forming unit 703 starts to form an image in accordance with a received image-forming start signal.

Figure 11:
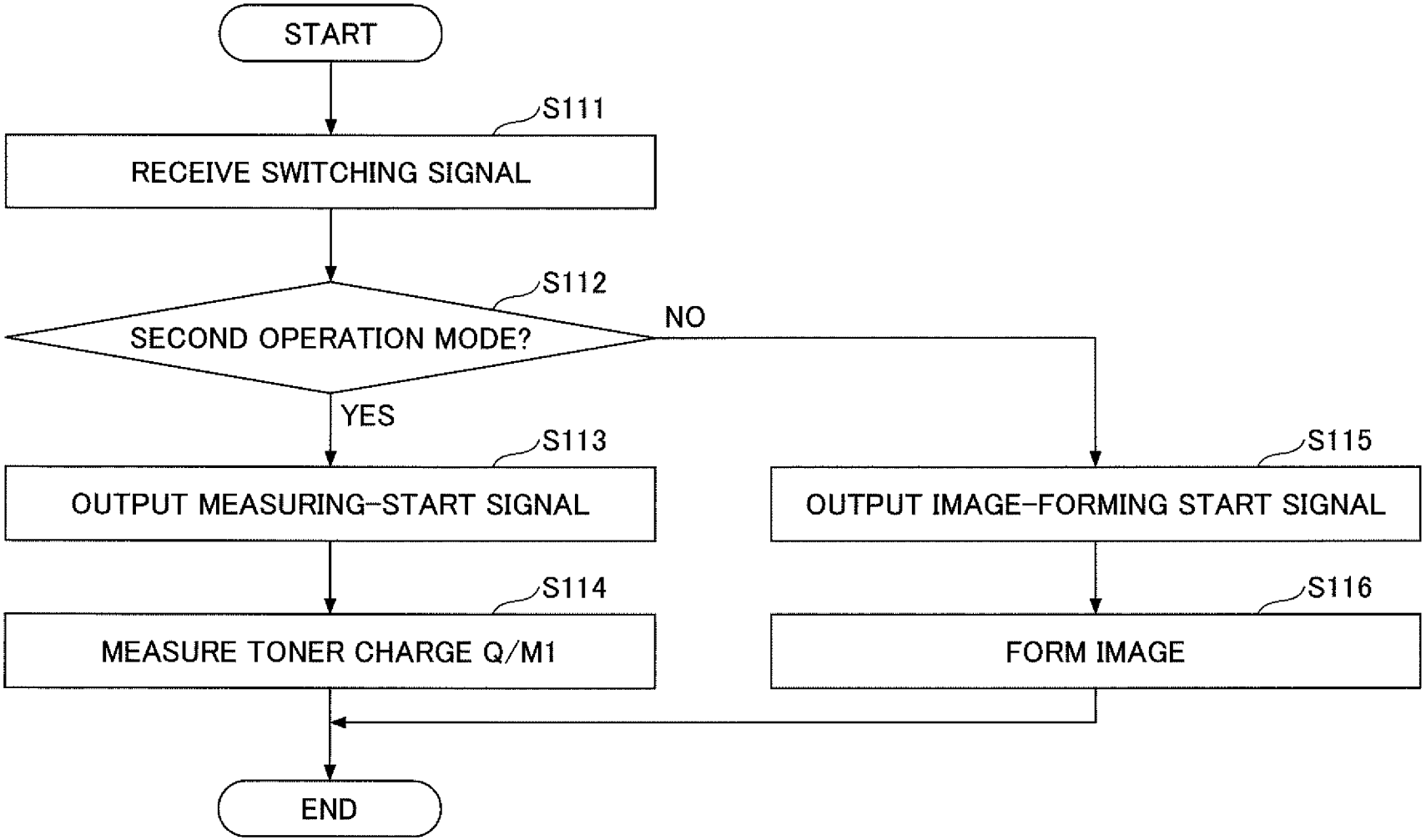
FIG. 11 is a flowchart illustrating an example of processing performed by a controller according to the second embodiment.

FIG. 11 is a flowchart illustrating an example of processing performed by a controller 700*a*.

First, in step S111, the receiver 701 receives a switching signal input from an operation unit or the like, which is provided with the image forming apparatus 100*a*, and outputs the received switching signal to the switching unit 702.

In step S112, the switching unit 702 determines whether the received switching signal indicates a second operation mode. If the switching unit 702 determines that the image forming apparatus is operating in the second operation mode (Yes in step S112), in step S113, the switching unit 702 outputs, to the control board 600, a measuring-start signal for instructing to start measuring a toner charge Q/M1.

In step S114, the control board 600 measures the toner charge Q/M1 in accordance with the measuring-start signal that is received via the input and output unit 610.

On the other hand, in step S112, If the switching unit 702 determines that the image forming apparatus is not operating in the second operation mode is not determined (No in step S112), in step S115, the switching unit 702 outputs, to the image forming unit 703, an image-forming start signal for instructing to start forming an image.

In step S116, the image forming unit 703 forms an image in accordance with a received image-forming start signal.

As described above, in the present embodiment, the image forming apparatus 100*a* switches between a first operation mode of forming an image on a paper and a second operation mode of measuring a toner charge Q/M1, in accordance with a switching signal that is input to the image forming apparatus 100*a*. The second operation mode differs from the first operation mode. Thereby, operations of measuring a toner charge Q/M1 and forming an image on a paper can be switched.

Other effects are similar to the effects described in the first embodiment.

Explanation has been provided above for the image forming apparatus according to the embodiments. However, the present disclosure is not limited to the above embodiments, and various changes and modifications can be made within the scope of the present disclosure.

One or more embodiments also provide a method of measuring a toner charge. For example, the method for measuring a toner charge includes moving, by a first image formation unit among a plurality of image formation units, first toner on a first toner bearer to a first image bearer to form a first toner image on the first image bearer, the first toner image being a predetermined pattern of defining a reference toner image. The method includes transferring the first toner image on the first image bearer onto an intermediate transfer body based on a first transfer bias current, and moving, by at least one second image formation unit downstream of the first image formation unit, second toner on a second toner bearer to a second image bearer to form a second toner image on the second image bearer. The method includes transferring the second toner image on the second image bearer onto the intermediate transfer body based on a second transfer bias current, and includes measuring a total charge of the first toner included in the reference toner image based on a developing current that flows in response to moving the first toner from the first toner bearer to the first image bearer. The method includes measuring an adhered amount of the first toner included in the reference toner image that is transferred from the first image bearer onto the intermediate transfer body, and includes measuring a first toner charge per unit mass based on the total charge and the adhered amount. The method includes setting, with respect to the second-transfer bias current, a first current value for measuring the first toner charge per unit mass and a second current value for forming an image on a print medium, the first current value being lower than a current value of the first transfer bias current, and the first current value being different from the second current value.

Such a method of measuring a toner charge can have a similar effect to the effect in the image forming apparatus described above.

What is claimed is:

1. An image forming apparatus comprising:

an intermediate transfer body;

a plurality of image formation units arranged in a direction along which the intermediate transfer body moves, each image formation unit including:

a first image formation unit including a first toner bearer and a first image bearer, the first image formation unit being configured to move first toner on the first toner bearer to the first image bearer to form a first toner image on the first image bearer, and at least one second image formation unit disposed downstream of the first image formation unit, the second image formation unit including a second toner bearer and a second image bearer, the second image formation unit being configured to move given second toner on the second toner bearer to the second image bearer to form a second toner image on the second image bearer, and a first transfer unit configured to cause the first toner image to be transferred onto the first image bearer onto the intermediate transfer body based on a first transfer bias current supplied to the first transfer unit, the first toner image being a predetermined pattern of defining a reference toner image;

at least one second transfer unit configured to cause the second toner image on the second image bearer to be transferred onto the intermediate transfer body based on a second transfer bias current supplied to the second transfer unit;

a first measuring unit configured to measure a total charge of the first toner included in the reference toner image based on a developing current that flows in response to moving the first toner from the first toner bearer to the first image bearer;

a second measuring unit configured to measure an adhered amount of the first toner included in the reference toner image that is transferred from the first image bearer onto the intermediate transfer body;

a third measuring unit configured to measure a first toner charge per unit mass based on the total charge and the adhered amount; and a current controller configured to set, with respect to the second-transfer bias current, a first current value for measuring the first toner charge per unit mass and a second current value for forming an image on a print medium, the first current value being lower than a current value of the first transfer bias current, and the first current value being different from the second current value.

2. The image forming apparatus according to claim 1, wherein the current controller is configured to set the first current value of the second transfer bias current to be lower than the second current value of the second transfer bias current.

3. The image forming apparatus according to claim 1, further comprising a controller including:

a receiver configured to receive a switching signal; and a switching unit configured to switch between a first operation mode of forming the image on the print medium and a second operation mode of measuring the first toner charge per unit mass, in accordance with the switching signal.

4. A method for measuring a toner charge comprising:

moving, by a first image formation unit among a plurality of image formation units, first toner on a first toner bearer to a first image bearer to form a first toner image on the first image bearer, the first toner image being a predetermined pattern of defining a reference toner image;

transferring the first toner image on the first image bearer onto an intermediate transfer body based on a first transfer bias current;

moving, by at least one second image formation unit downstream of the first image formation unit, second toner on a second toner bearer to a second image bearer to form a second toner image on the second image bearer;

transferring the second toner image on the second image bearer onto the intermediate transfer body based on a second transfer bias current;

measuring a total charge of the first toner included in the reference toner image based on a developing current that flows in response to moving the first toner from the first toner bearer to the first image bearer;

measuring an adhered amount of the first toner included in the reference toner image that is transferred from the first image bearer onto the intermediate transfer body;

measuring a first toner charge per unit mass based on the total charge and the adhered amount; and setting, with respect to the second-transfer bias current, a first current value for measuring the first toner charge per unit mass and a second current value for forming an image on a print medium, the first current value being lower than a current value of the first transfer bias current, and the first current value being different from the second current value.

* * * * *